US006124069A

United States Patent [19]

Bartus et al.

[11] Patent Number: 6,124,069

[45] Date of Patent: Sep. 26, 2000

[54] ELECTROPHOTOGRAPHIC CARRIER COMPRISING A COATING OF A GRAFTED FLUOROPOLYMER

[75] Inventors: Jan Bartus, Merrimack; Wilfred Emerson Vail, Litchfield, both of N.H.

[73] Assignee: Nashua Corporation, Nashua, N.H.

[21] Appl. No.: 09/318,085

[22] Filed: May 25, 1999

Related U.S. Application Data

[60] Provisional application No. 60/086,744, May 26, 1998.

[51] Int. Cl.[7] ..... G03G 9/113

[52] U.S. Cl. ..... 430/108

[58] Field of Search ..... 430/106, 108

[56] References Cited

U.S. PATENT DOCUMENTS

| | | | |
|---|---|---|---|
| 5,512,403 | 4/1996 | Tyagi et al. | 430/106.6 |
| 5,514,513 | 5/1996 | Cunningham et al. | 430/137 |
| 5,518,855 | 5/1996 | Creatura et al. | 430/137 |
| 5,567,562 | 10/1996 | Creatura et al. | 430/108 |
| 5,665,507 | 9/1997 | Takagi et al. | 430/108 |

FOREIGN PATENT DOCUMENTS

| | | |
|---|---|---|
| 0 248 421 | 12/1987 | European Pat. Off. . |
| 60-202245 | 10/1985 | Japan . |
| 61-017153 | 1/1986 | Japan . |
| 1-282565 | 11/1989 | Japan . |

*Primary Examiner*—John Goodrow

*Attorney, Agent, or Firm*—George W. Neuner; Dike, Bronstein, Roberts and Cushman LLP

[57] ABSTRACT

A carrier composition is provided for electrophotographic development. Core particles are coated with a graft copolymer of a fluoropolymer and methyl methacrylate. The core particles preferably are a material selected from steel, nickel, iron, ferrites, passivated iron, or mixtures or alloys thereof. The fluoropolymer preferably is a polymer selected from chlorotrifluoroethylene, polyvinylidene fluoride, polytrifluoroethylene, polytetrafluoroethylene, copolymers of vinylidene fluoride and hexafluoropropylene, and copolymers of vinylidene fluoride and tetrafluoroethylene. In a preferred carrier composition, the coating consists of two layers. The exterior layer is a graft copolymer made of a fluoropolymer and methyl methacrylate.

17 Claims, 3 Drawing Sheets

ELECTROPHOTOGRAPHIC CARRIER COMPRISING A COATING OF A GRAFTED FLUOROPOLYMER

This application claims the benefit of U.S. Provisional No. 60/086,744 filed May 26, 1998.

BACKGROUND OF THE INVENTION

The present invention relates to electrophotographic carrier particles, and particularly to carrier particles for electrophotographic developers comprising a fluoropolymer coating, wherein a monomer species is grafted to the fluoropolymer.

Electrophotographic processes and apparatus employ the use of developers to form visible images that are typically transferred to and fixed on a paper sheet. The developers comprise a toner, which typically comprises a resin and a colorant, along with other desirable additives such as charge control agents. In general, a desired image is formed on an organic photoconductor (OPC) coated medium such as a drum or belt in the form of a charged pattern representing the image. Toner is electrically attracted to the charge on the drum and adheres to the drum in an imagewise manner. Then, the toner image is transferred from the OPC medium to an image-receiving substrate (typically paper) and fused, resulting in permanent image formation.

In many development systems, charge is imparted to the toner triboelectrically by mixing toner particles with carrier particles, typically, particles about 20 to 200pm in diameter. In magnetic brush development systems, the carrier particles are preferable resin-coated ferromagnetic particles. The toner particles adhere to the oppositely-charged carrier particles and are conveyed to the photoconductor where the toner is attracted to and deposited on the oppositely-charged latent image areas of the photoconductor. The carrier particles are collected and recycled for remixing with additional toner.

Because the carrier is a recyclable component of the developer, it is desirable to make the carrier last as long as possible, to minimize cost of usage. After a period of use, toner particles tend to irreversibly adhere to the carrier, rendering triboelectric charging ineffective and necessitating replacement of the carrier. This is a problem sometimes referred to as "toner filming" or "scum" and can be found when using fluoropolymer coating materials such as polytetrafluoroethylene (PTFE). However, such fluoropolymer materials are triboelectrically desirable for use in making the carrier. Typically, fluoropolymers have a low surface free energy due to the presence of carbon-to-fluorine bonds and, as such, make ideal materials for carrier coating. Toner filming or scum may be suppressed by incorporating certain silicones and copolymers of tetrafluoroethylene (TFE), p-vinylidene fluoride, and the like. The lack of adhesion problem has been addressed by the provision of another agent such as a heat-curable epoxy system to adhere the PTFE to the substrate, but this solution is less than desirable because the presence of the epoxy alters the characteristics of the end-product carrier material.

Another problem with prior art developers relates to solid area development and the control thereof. In carrier/toner systems, uniform application of toner across a relatively large image on the document is desired. This is commonly called "solid area fill." During formation of a latent image on the photoconductor surface, an electric field is formed of the size and shape of the optically projected image (i.e., "imagewise"). Electrostatic field lines of force tend to migrate to the edges of the latent image field and toner, during development, is deposited along these lines of force. If the shape of the field is not corrected, most toner will be deposited along the edges of the latent image field, resulting in little or no development of the interior of the image, a condition known as "hollow character defect" or "edging."

One solution to correct this defect is to move a conductive bar or the like into the field, whose force lines project into space. This has the effect of making the field lines project perpendicularly to the photoconductor surface and to space themselves evenly across the large solid image field. This effect is commonly known as the "development electrode effect."

Ferromagnetic carriers used in magnetic brush development take the place of solid development electrodes. If they are sufficiently conductive, the carrier particles render excellent solid area fill to large image areas. The conductivity of the carrier particle determines the strength of the development electrode effect.

Examples of carrier core materials used in the prior art range from extremely resistive flint glass (which is only able to develop solid areas not larger than ordinary type fonts) to powdered iron and steel, which develops excellent solid area fill. However, particles containing iron can be highly susceptible to rusting in high moisture environments, or the formation of "scale," which interferes with carrier coating adhesion. These core materials generally must be passivated and cleaned, either chemically or by surface oxidation.

Synthetic ferrite core materials are not rendered useless by moisture, because they are formed from metal oxides. They are more resistive than iron and more conductive than glass beads. To improve their solid area image development, however, it is usually necessary to incorporate electroconductive particles in the coating to enhance the development electrode effect.

Another problem encountered with carriers having fluoropolymer coatings is that such coatings can impart excessive triboelectric charge to positive (+) toners, resulting (i) in decreased toner development and lower image density than desired or (ii) in excessive attraction of toner to carrier, resulting in high toner concentration leading to "background" on developed copies.

Accordingly, improved development systems including improved carrier particles continue to be desired.

SUMMARY OF THE INVENTION

The present invention provides a carrier composition for electrophotographic development that comprises core particles coated with a graft copolymer comprising a fluoropolymer and methyl methacrylate. Modification of the chargeable surface of the carrier coatings can be accomplished by varying the degree of polymerization of the grafted methyl methacrylate portion, resulting in longer or shorter chains.

The electrophotographic carriers of the present invention are particularly useful with positive (+) toners. In preferred embodiments, the fluoropolymer used in the coating is modified by grafting charge-modifying monomers onto hydroperoxide groups found, after oxidation, on certain tertiary carbon atoms of the fluoropolymer. Carrier compositions of the invention permit the triboelectric charge imparted to toner particles by carrier coatings to be varied independent of the electroconductivity of the coatings.

In preferred embodiments, the grafted methyl methacrylate portion is present in the coating in an amount from about 0.5 to about 20 wt % of the total polymer, preferably from about 1 to about 10 wt %.

Typically, the coating is in the range of from about 0.4 to about 5 wt %, based on the weight of the uncoated carrier particles, more preferably from about 1.8 to about 2.8 wt %.

The carrier particle coating also can include carbon black or other components. For example, the coating can advantageously contain charge-controlling agents such as dyes. Preferably, the coating is applied to the carrier particles in two layers, wherein the presence and amount of carbon black and other components can be varied by layer. In preferred embodiments, the inner layer comprises from about 10 to about 30 wt % carbon black and the outer layer comprises from 0 to about 4 wt % carbon black, based on the total weight of solids in the layer.

In accord with the present invention, preferred carrier coatings can use fluoropolymers, which are desirable for their anti-filming properties, without imparting excessive triboelectric charge to positive (+) toners. Thus, preferred embodiments of the present invention can avoid decreased toner development and lower image density than desired, or an excessive attraction of toner to carrier, resulting in high toner concentration leading to "background" on developed copies.

DESCRIPTION OF THE INVENTION INCLUDING PREFERRED EMBODIMENTS

Figure 1:
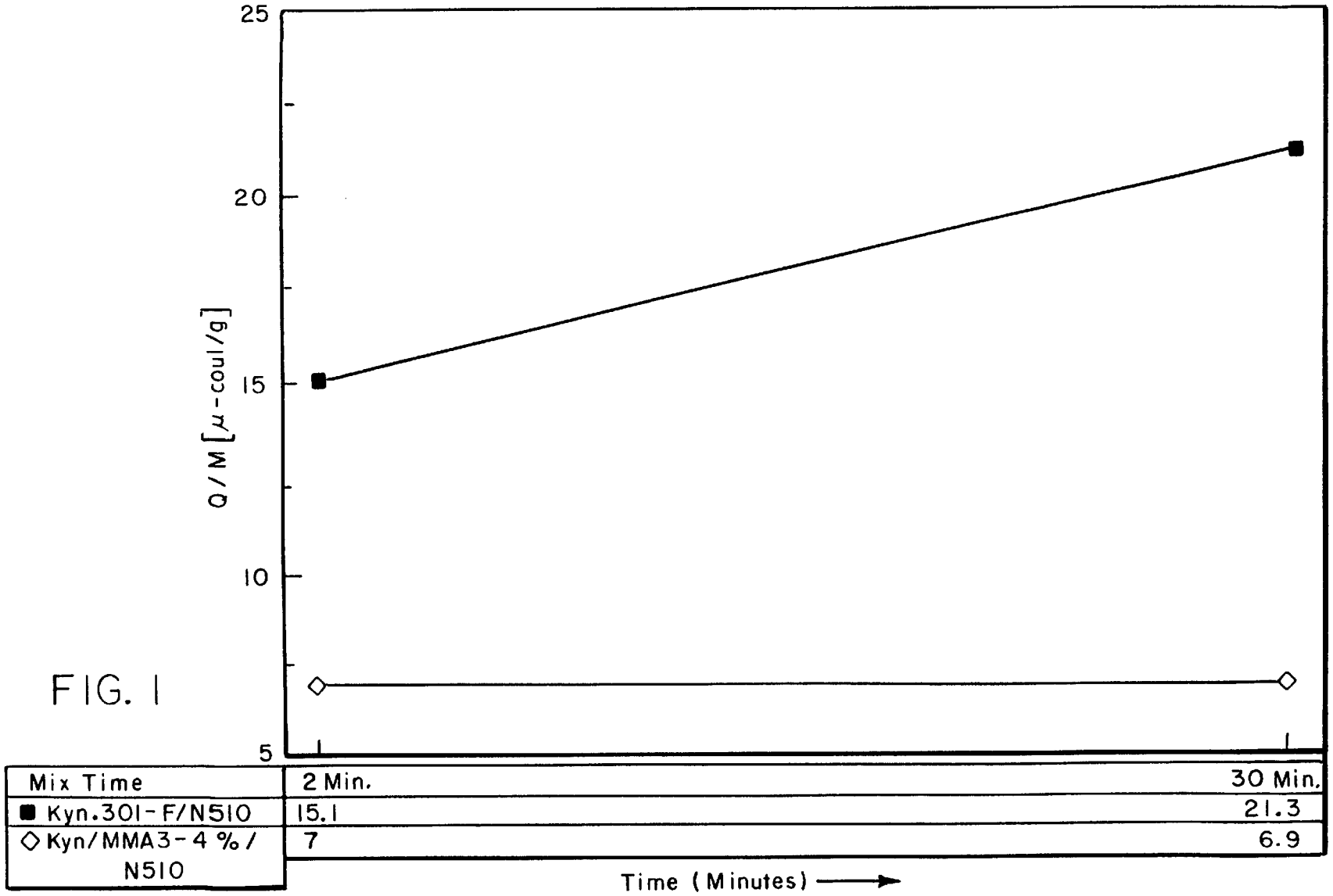
FIG. 1 is a graph illustrating the charge to mass ratio for a commercial toner mixed with a carrier having a graft copolymer coating in accord with present invention compared to mixing with carrier having a prior art fluoropolymer coating.

In accord with the present invention, a carrier composition for electrophotographic development comprises core particles coated with a graft copolymer comprising a fluoropolymer and methyl methacrylate.

The carrier particles or core material for the carrier composition can be selected from any of a wide variety of carrier particles well known to those skilled in the art. Preferably, the carrier particles are formed from a conductive material such as ferromagnetic materials, steel, nickel, iron, ferrites, passivated iron, or mixtures or alloys thereof. The average particle size (diameter) of the core is typically in the range of 20 to 200 $\mu$m. In one preferred embodiment, the core material is preferably a material that will resist corrosion that might otherwise occur as a result of core particles being exposed to aqueous coating solutions. In this regard, materials such as ferrite or passivated iron are preferred. Depending on the type of development system under consideration, the surface and shape of the core particles can be smooth or irregular.

The fluoropolymer used in the coating can be selected from a variety of fluoropolymers such as, for example, chlorotrifluoroethylene, polyvinylidene fluoride, polytrifluoroethylene, polytetrafluoroethylene, copolymers of vinylidene fluoride and hexafluoropropylene, copolymers of vinylidene fluoride and tetrafluoroethylene, and the like. The fluoropolymer is modified by graft polymerization with methyl methacrylate. The procedure used to graft the methyl methacrylate monomers onto desired fluoropolymers is based on the system described by J. Bartus in *Chemical Papers* 41, 751 (1987) ("A New Initiation Redox System for synthesis of Grafted Copolymers"), the disclosure of which is hereby incorporated by reference.

Generally, the grafting was carried out in an emulsion system in the presence of hydroperoxidated polymer, Cu(II) salt, and ammonia as complex-forming components and an organic or inorganic reducing agent. Thus, the fluoropolymer is oxidized in an oven to provide sites for grafting the methyl methacrylate monomer. The amount of monomer incorporated into the graft copolymer depends upon the degree of oxidation of the fluoropolymer, the amount of monomer charged into the system, the reaction temperature and length of reaction time. In certain preferred embodiments, the amount of polymethyl methacrylate (PMMA) in the graft copolymer is preferably from about 0.5 wt % to about 6.0 wt %, based on the weight of the copolymer, more preferably from about 1.0 wt % to about 3.0 wt %, based on the weight of the copolymer. However, the amount of grafted PMMA can be varied further to achieve the desired triboelectric properties for the coating.

Conductive material can be used in the coating to tailor the electroconductive properties of the carrier particles. Electroconductive particles that are well known in the art, such as finely divided carbon black, furnace black, acetylene black and channel black, can be used. Other materials, such as inorganic materials including metal borides, carbides, nitrides, oxides and silicides, which have low volume resistivities but can act as development electrodes, can also be used, alone or in combination with the other electroconductive particles disclosed herein. Electroconductive particle size (diameter) is typically 1 $\mu$m or less, preferably 0.5 $\mu$m or less. Generally, such particles are present in an amount of about 0.5 to about 30 wt %, based on the total solids weight of the coating. The particular amount depends upon the electrical characteristics that are desired, the number of layers in the coating, and the particular layer being formulated.

The coating can be applied in one or more layers on the carrier particles. The amount of coating in each layer will depend on the particular application, i.e., the resistance and/or conductivity desired, but can be adapted to core materials having widely varying surface areas and shapes. About 0.5 to about 2.0 wt % of polymer coating, based on the carrier core weight has been sufficient conductive material for many applications. Also, about 1.5 to about 2.0 wt % of polymer coating has been found to provide a sufficient resistivity ($1–5\times10^9$ ohms at 10–500V) for copying systems such as conventional RICOH copiers. Generally, the coating (s) are continuous and/or uniform, but good results also can be obtained employing a discontinuous and/or non-uniform coating.

When two layers are used, typically the first or inner layer is used to augment electroconductive properties of the core material and the second or outer layer serves as an insulator. The outer, insulative layer triboelectrically charges the toner particles during the electrophotographic process, and shields the conductive inner portion of the carrier from contact with toner particles or other carrier particles. The presence of the outer layer can permit altering properties of the carrier composition as a development electrode while ensuring that the toner charging properties are not adversely impacted. In a preferred embodiment, the outer insulative layer is made of the same matrix material as the inner layer. More specifically, in a preferred embodiment, both layers are formed predominantly of a fluoropolymer matrix material. In preferred embodiments, the inner layer is from about 0.4 wt % to about 1.8 wt %, based on the weight of the starting carrier particles, and the outer layer is from about 0.7 wt % to about 3 wt %, based on the weight of the starting carrier particles.

In certain embodiments, the outer layer can contain the graft copolymer described herein while the inner layer is a conventional polymer or fluoropolymer. The coating can also include charge-controlling agents, which further control the charge to mass ratio (q/m) of toner, preferably in the outer layer. For example, the q/m of positive (+) toners may be lowered by incorporation of a negative (−) charge controlling agent, or may be increased by incorporation of a positive (+) charge controlling agent, such as disclosed in U.S. Pat. No. 5,627,001. A surprising and advantageous result of this formulation is that the q/m can be varied independently from the resistance of the carrier particles.

Charge-controlling agents known in the art which may be used in the formulation of the coating layer include Nigrosine dyes, triaminotriphenylmethanes, cationic dyes, alkyl pyridinium halides such as cetyl pyridinium halide, organic sulfates or sulfonates, quaternary ammonium halides, methyl sulfates, distearyl dimethyl ammonium sulfate, bisulfates, dioxazines, and the like. Negative charge agents that may be used include heliogen green pigment; metal complexes of phthalic acid, naphthoic acid, or salicylic acid; copper phthalocyanines; perylenes; quinacridones; o-fluorobenzoic acids; p-halo phenyl carboxylic acids; azo pigments; metal salt azo pigments; azochromium complexes; chromate (1-) bis{3-hydroxy-4 -[(2-hydroxy-3, 5-dinitrophenyl) azo]-N-phenyl-2-naphthalene carboxamato (2-)}-hydrogen ("TRH") or salts thereof; and the like.

The amount of charge controlling agent to be added to the outer layer will depend on the particular purpose for which the carrier particles are intended, and is readily determinable by those of ordinary skill in the art. However, it has been found that, e.g., about 0.5 to about 6 wt % based on the total coating weight is suitable in practice when employed with positive toners.

The carrier particles can be coated using any conventional method such as solvent coating or dry coating followed by heat treatment to melt the coating onto the core particles. Preferably, a water-based coating process is used, which can offer certain performance and environmental advantages. Charge control dyes, when used, are preferably finely and uniformly dispersed to charge toner particles to the same degree, regardless of toner orientation on the carrier surface.

A preferred coating method employs water as the dispersing and coating vehicle. A water soluble temporary binder permits control of the dispersion of fluoropolymer, electroconductive particles, and charge-control dyes using conventional dispersing apparatus, as well as allowing the controlled and uniform application of such coatings by ordinary methods and equipment, such as Würster-column fluidized bed sprayers, modified vacuum drier coaters, and the like.

An aqueous suspension of fluoropolymer may be prepared by dispersing the fluoropolymer in aqueous solution with the aid of a water-soluble "temporary" binder which is subsequently destroyed by heating during fusing of the coating onto the carrier particle. The water soluble temporary binder further provides a means for dispersing electroconductive particles throughout the suspension, and has been found to aid in adhesion of the fluoropolymer binder to the carrier particle. The water soluble temporary binder is particularly useful in preparing the inner layer. Although it is generally unnecessary for the dispersion of fluoropolymer, the binder assists in coating adhesion to the surface of the core material and providing abrasion resistance during fluidized bed operation. The water soluble temporary binder is preferably a cellulose-based material such as alkyl cellulose, e.g., hydroxypropylmethylcellulose, methylcellulose, and the like.

After the coating has been applied to the carrier particles, the coating preferably is fixed by conventional thermal fusing, e.g., in a rotary kiln or tube furnace. During this process the water-soluble temporary binder is oxidized and eliminated from the surface of the carrier particle and the fluoropolymer or other suitable resin of the coating layer is melted.

Additional benefits and understanding of the present invention will be apparent from the Examples that follow.

EXAMPLE 1

Fluoropolymer without Graft Methylmethacrylate

The carrier composition was made with a copper-zinc ferrite core (Steward) of approximately 80$\mu$ mean diameter coated with two layers.

The dispersion for a first layer (or inner layer) consisted of a mixture of Kynar 301-F (ELF Atochem), 77.5 parts, and Conductex 975 conductive carbon (Columbian), 22.5 parts, by weight. The mixture was combined with a solution containing 5 wt % of Methocel A15LV (Dow) in the ratio of 100 parts by weight of mixture to 7 parts by weight of the Methocel solution. A sufficient amount of water was added to make a dispersion having 18 wt % total solids. Six drops of Triton X-100 (Kodak) was added as a wetting agent and the mixture placed in a ceramic ball mill jar with sintered alumina ½" rods, as grinding media, occupying about one half of the mill volume. The mixture was milled for 21 hours to effect size reduction and dispersion of the carbon.

The dispersion for a second layer (outer layer) consisted of Kynar 301-F, 95 parts, and T-77 dye (Hodogaya), 5 parts by weight, to which was added a 5% solution of Methocel as for the first layer. The mixture was milled in the same manner.

Both layers were consecutively coated onto the copper-zinc ferrite core (Steward), which had a mean particle diameter of approximately 80$\mu$ by means of a W ürster-Column fluidized bed sprayer (Lakso). For the first layer, sufficient dispersion was sprayed onto the carrier particles to provide a coating having 0.8 wt % solids (excluding the Methocel), based on the weight of the carrier particles. The inlet air temperature during coating was 144° F. and the outlet air temperature was 103–107° F.

The second layer was then applied in a similar manner. Sufficient dispersion for the second layer was sprayed onto the carrier particles to provide a coating having 1.5 wt % solids (excluding the Methocel), based on the weight of the carrier particles. The inlet air temperature during coating was 144° F. and the outlet air temperature was 103–107° F.

After coating, the dried product was introduced into a rotating 1½" diameter tube furnace (Thermcraft) and the coating thermally fused onto the substrate at 265° C. at a feed rate of about 600 g/hr. The material, essentially free of the Methocel binder and having the Kynar melted onto the ferrite, was cooled, crushed and sieved through a U.S. Std. 100 mesh sieve to give a free-flowing carrier powder.

EXAMPLE 2

Fluoropolymer with Graft Methyl Methacrylate

The carrier composition was made with a copper-zinc ferrite core (Steward) of approximately 80$\mu$ mean diameter coated with two layers. In this example, the Kynar 301-F was modified by grafting methyl methacrylate (MMA) in the amount of approximately 3.5 wt. % of polymer.

The graft methyl methacrylate fluoropolymer was prepared as follows. Into a 5 liter glass reactor equipped with thermometer, condenser, nitrogen inlet and outlet, the following components were added: 250 g of Kynar 301-F (previously oxidized in an oven for 14 hours at 115° C.), 107 g of methyl methacrylate (Rohm Tech Inc.), 50 g of ammonium hydroxide (Aldrich Chemical Company), as a 28 % water solution, 25 g of Emulgator K-30 (Bayer Corp.), 0.4 g of copper(II) sulfate pentahydrate (Aldrich Chemical Company), 5 g of $\alpha$-D-glucose (Aldrich Chemical Company), and 2500 g of distilled water. The contents of the reactor were homogenized with a Teflon blade stirrer at 100 rpm, bubbled with nitrogen for 15 minutes, and heated to 70° C. The grafting reaction proceeded under stirring for 6 hours. The temperature was reduced to 30° C. and the grafted copolymer was separated by a centrifuge and dried in an oven at 60° C. The infrared analysis confirmed the presence 3.5 % by weight of incorporated polymethyl methacrylate (PMMA). Extraction with toluene showed that 85% of the PMMA was grafted to the Kynar 301-F.

The dispersion for the first layer consisted of 70 parts by weight MMA-grafted Kynar 301-F and 30 parts Conductex 975. It was compounded in the same manner as the dispersions in EXAMPLE 1 using Methocel, except that the Methocel was present in amount of 11 % based on the weight of the mixture of polymer and carbon. The first layer was coated, as in EXAMPLE 1, onto the copper-zinc ferrite core (Steward), which had a mean particle diameter of approximately 80$\mu$, to provide a first layer having 0.5 wt % of the core material.

The second layer consisted of 98 parts by weight MMA-grafted Kynar 301-F and 2 parts by weight Conductex 975. It was compounded in the same manner as the dispersions in EXAMPLE 1 using Methocel, except that the Methocel was present in amount of 11% based on the weight of the mixture of polymer and carbon. The second layer was coated, as in EXAMPLE 1, onto the carrier particles already coated with the first layer, to provide an outer layer having 1.2 wt % of the core material.

Charge-to-mass measurements at 2-minute and 30-minute mixing times were made with the carrier compositions of EXAMPLE 1 and 2 using commercial toners on a standard "opposing air-jet" blow-off apparatus using a Keithley Electrometer, as described in *J. Applied Physics,* Vol. 46, No. 12, pp. 5140–49 (1975).

Charge-to-mass measurements were:

| Carrier Coating | Toner* | $\mu$-C/g: 2 min. | 30 Minutes |
|---|---|---|---|
| EXAMPLE 1 | N510 | 15.1 | 21.3 |
| EXAMPLE 1 | N4418 | 17.9 | 24.9 |
| EXAMPLE 2 | N510 | 7.0 | 6.9 |
| EXAMPLE 2 | N4418 | 6.9 | 8.5 |

*Manufactured by Nashua Corporation, Nashua, New Hampshire

Figure 2:
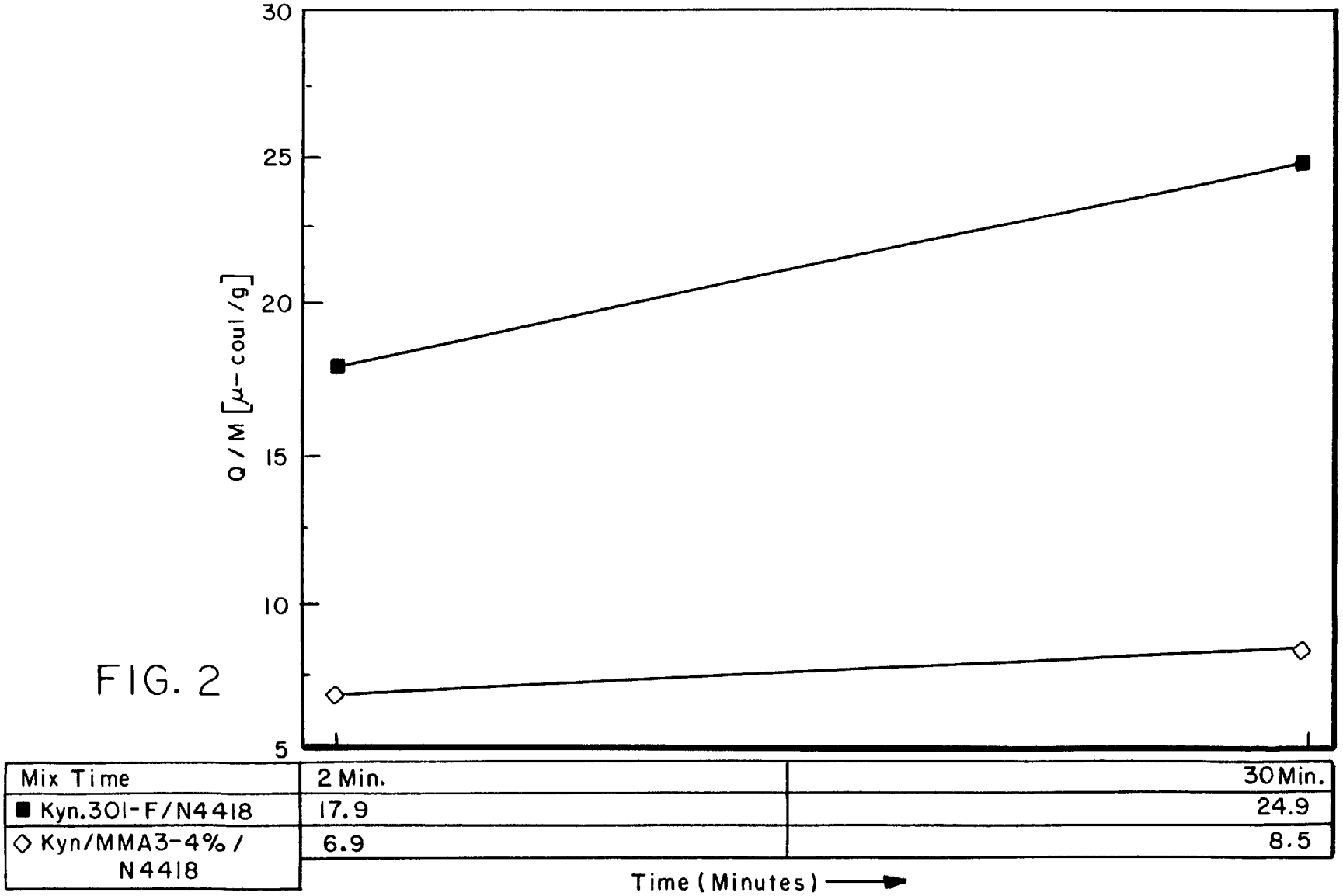
FIG. 2 is a graph illustrating the charge to mass ratio for another commercial toner mixed with a carrier having a graft copolymer coating in accord with present invention compared to mixing with carrier having a prior art fluoropolymer coating.

The results are plotted in FIG. 1 (N510) and FIG. 2 (N4418).

Figure 3:
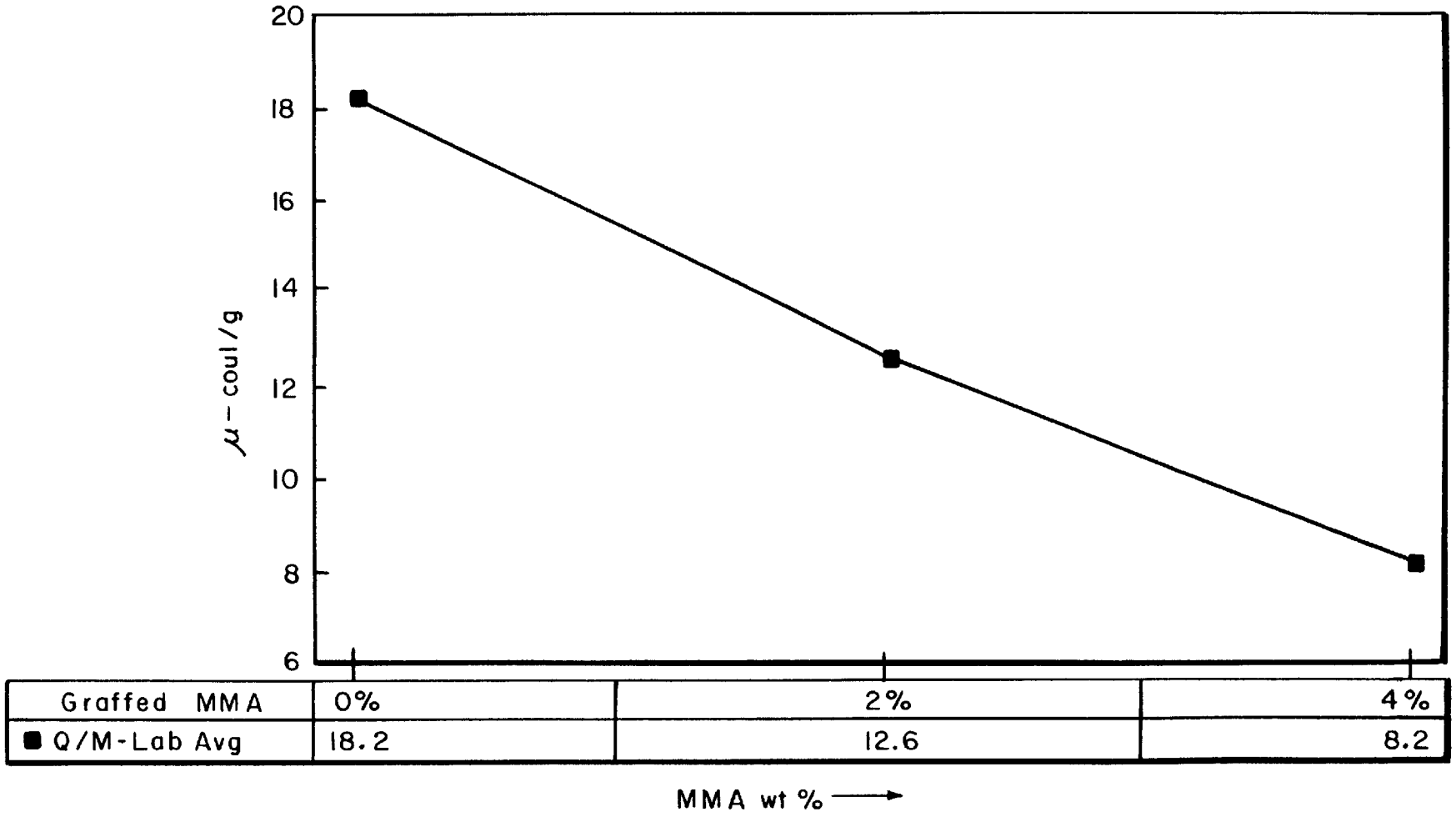
FIG. 3 is a graph illustrating the charge to mass ratio as a function of the weight percent of methyl methacrylate in the graft fluoropolymer copolymer.

Developers were blended for evaluation in a photocopying machine. The carrier having a coating with electropositive MMA grafted onto the fluoropolymer showed significant lowering of the charge and toner concentration when compared with the ungrafted Kynar 301-F. FIG. 3 illustrates the variation in toner concentration in a Ricoh 4418 type copier due to variation in the amount of graft monomer in the fluoropolymer of the coating.

The invention has been described in detail with reference to preferred embodiments thereof. However, it will be appreciated that, upon consideration of the present specification and drawings, those skilled in the art may make modifications and improvements within the spirit and scope of this invention as defined by the claims.

We claim:

1. A carrier composition for electrophotographic development comprising core particles coated with a graft copolymer comprising a fluoropolymer and methyl methacrylate.

2. The carrier composition of claim 1, wherein the core particles comprise a material selected from the group consisting of steel, nickel, iron, ferrites, passivated iron, or mixtures or alloys thereof.

3. The carrier composition of claim 1, wherein the core particles comprise copper-zinc ferrite.

4. The carrier composition of claim 1, wherein the fluoropolymer comprises a polymer selected from the group consisting of chlorotrifluoroethylene, polyvinylidene fluoride, polytrifluoroethylene, polytetrafluoroethylene, copolymers of vinylidene fluoride and hexafluoropropylene, and copolymers of vinylidene fluoride and tetrafluoroethylene.

5. The carrier composition of claim 1, wherein the fluoropolymer comprises polyvinylidene fluoride.

6. The carrier composition of claim 1, wherein the coating further comprises carbon black.

7. The carrier composition of claim 6, wherein the carbon black is present in an amount from about 10 to about 30 wt % based on the total weight of carbon black and graft copolymer.

8. The carrier composition of claim 1, wherein the amount of methyl methacrylate present in the graft copolymer is from about 0.5 to about 6.0 wt % based on the weight of graft copolymer.

9. A carrier composition for electrophotographic development comprising core particles coated with a graft copolymer comprising a fluoropolymer and methyl methacrylate, wherein the coating comprises two layers, the exterior layer comprising a graft copolymer comprising a fluoropolymer and methyl methacrylate.

10. The carrier composition of claim 9, wherein the fluoropolymer comprises a polymer selected from the group consisting of chlorotrifluoroethylene, polyvinylidene fluoride, polytrifluoroethylene, polytetrafluoroethylene, copolymers of vinylidene fluoride and hexafluoropropylene, and copolymers of vinylidene fluoride and tetrafluoroethylene.

11. The carrier composition of claim 9, wherein the fluoropolymer comprises polyvinylidene fluoride.

12. The carrier composition of claim 9, wherein the coating further comprises carbon black.

13. The carrier composition of claim 12, wherein the carbon black is present in an amount from about 10 to about 30 wt % based on the total weight of carbon black and graft copolymer.

14. The carrier composition of claim 9, wherein the amount of methyl methacrylate present in the graft copolymer is from about 0.5 to about 6.0 wt % based on the weight of graft copolymer.

15. A carrier composition for electrophotographic development comprising core particles coated with a graft copolymer comprising a fluoropolymer and methyl methacrylate, wherein the coating comprises two layers, wherein a first inner layer comprises a first graft copolymer comprising a fluoropolymer and methyl methacrylate, the first graft copolymer further containing carbon black, and wherein a second outer layer comprises a second graft copolymer comprising a fluoropolymer and methyl methacrylate, the second graft copolymer further containing a charge control agent.

16. A carrier composition for electrophotographic development comprising core particles coated with a graft copolymer comprising a fluoropolymer and methyl methacrylate, wherein the coating comprises two layers, wherein a first inner layer comprises a first graft copolymer comprising a fluoropolymer and methyl methacrylate in amount of from 0.5 to about 6 wt % based on the weight of the graft copolymer, the first graft copolymer further containing carbon black in an amount of about 10 to about 30 wt % based on the total weight of carbon black and the first graft copolymer, and wherein a second outer layer comprises a second graft copolymer comprising a fluoropolymer and methyl methacrylate in amount of from 0.5 to about 6 wt % based on the total weight of carbon black and the second graft copolymer, the second graft copolymer further containing a charge control dye.

17. A carrier composition for electrophotographic development comprising core particles coated with a graft copolymer comprising a fluoropolymer and methyl methacrvlate, wherein the coating comprises two layers, wherein a first inner layer comprises a first graft copolymer comprising a fluoropolymer and methyl methacrylate in amount of from 0.5 to about 6 wt % based on the weight of the graft copolymer, the first graft copolymer being provided in an amount from about 0.4 to about 1.8 wt % based on the weight of uncoated core particles and the first graft copolymer further containing carbon black in an amount of about 10 to about 30 wt % based on the total weight of carbon black and the first graft copolymer, and wherein a second outer layer comprises a second graft copolymer comprising a fluoropolymer and methyl methacrylate in amount of from 0.5 to about 6.0 wt % based on the weight of the second graft copolymer, the second graft copolymer being provided in an amount from about 0.7 to about 3 wt % based on the weight of uncoated core particles and the second graft copolymer further containing a charge control dye and carbon black in an amount of 0 to about 4.0 wt % based on the total weight of carbon black and the second graft copolymer.

* * * * *